US008042625B2

(12) United States Patent
Chafai et al.

(10) Patent No.: US 8,042,625 B2
(45) Date of Patent: Oct. 25, 2011

(54) DRILLING TOOL

(75) Inventors: Ridha Chafai, Gloucestershire (GB); James Edward Wallace, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 12/610,406

(22) Filed: Nov. 2, 2009

(65) Prior Publication Data

US 2010/0108396 A1 May 6, 2010

(30) Foreign Application Priority Data

Nov. 3, 2008 (GB) ..... 0820063.6

(51) Int. Cl.
*E21B 10/26* (2006.01)

(52) U.S. Cl. ..... 175/398; 175/344; 175/385; 175/386; 175/406

(58) Field of Classification Search ..... 175/344, 175/385, 386, 398, 406
See application file for complete search history.

(56) References Cited

U.S. PATENT DOCUMENTS

| | | | | |
|---|---|---|---|---|
| 5,957,223 | A * | 9/1999 | Doster et al. | 175/57 |
| 6,394,200 | B1 | 5/2002 | Watson et al. | 175/385 |
| 6,606,923 | B2 * | 8/2003 | Hart et al. | 76/108.2 |
| 6,913,098 | B2 * | 7/2005 | Fielder et al. | 175/385 |
| 6,926,099 | B2 | 8/2005 | Thigpen et al. | 175/57 |
| 2004/0099448 | A1 | 5/2004 | Fielder et al. | 175/385 |

FOREIGN PATENT DOCUMENTS

| | | |
|---|---|---|
| EP | 0 058 061 A2 | 8/1982 |
| EP | 1 039 095 A2 | 9/2000 |
| EP | 1 085 167 A2 | 3/2001 |
| GB | 2 351 513 | 1/2001 |
| GB | 2 376 489 | 12/2002 |

OTHER PUBLICATIONS

GB0917279.2 Search Report (Jan. 26, 2010).

* cited by examiner

*Primary Examiner* — David Bagnell
*Assistant Examiner* — Richard Alker
(74) *Attorney, Agent, or Firm* — Conley Rose, P.C.

(57) ABSTRACT

A drilling tool has a body with a main drilling region and a pilot drilling region, eccentric to the main drilling region. The main drilling region has main blades and the pilot drilling region has pilot blades. The main drilling region has a main pass-through diameter, centered upon a first axis, one of the main blades extending to the main pass-through diameter, the pilot region having a pilot gauge diameter, centered upon a second axis of rotation at least one of the pilot blades extending to the pilot gauge diameter, wherein part of a circle of diameter equal to the pilot gauge diameter and centered upon the second axis of rotation extends outside of a circle of diameter equal to the main pass-through diameter and centered upon the first axis.

13 Claims, 3 Drawing Sheets

DRILLING TOOL

This application claims priority from provisional application GB0820063.6, filed Nov. 3, 2008.

BACKGROUND OF THE INVENTION

1. Field of the Invention

This invention relates to a drilling tool, and in particular to a rotary drilling tool intended for use in the drilling of boreholes, for example for subsequent use in the extraction of oil or natural gas.

2. Description of the Related Art

It is sometimes desirable to incorporate, in a borehole, regions of increased diameter. Obviously, if a relatively large diameter portion is to be drilled beneath a smaller diameter portion, the bit capable of drilling the large diameter portion has to be able to fit through the smaller diameter portion. One type of drill it is used in such applications includes a number of moving parts to allow the effective drilling diameter of the bit to be increased. Another type of drill bit used in this sort of application is a bi-centre drill bit. Such a bit is designed so as to permit it to be driven about two different axes of rotation. Rotation or support of the bit about a first, central axis results in the bit drilling or being capable of being passed through a relatively small diameter hole, rotation of the bit about a second axis eccentric to the main body of the bit resulting in a larger diameter being drilled. A pilot region of the drill bit is centred upon the second, eccentric axis of rotation and serves to drill a pilot hole, engagement of parts of the bit with the wall of the pilot hole serving to stabilise the bit.

For maximum stability, it is desirable for the pilot region to be of large diameter. However, increasing the size of the pilot region results in the two axes being fairly close to one another, reducing the maximum diameter of hole that can be drilled for a given size of tool.

EP 0058061 describes a bi-centre drill bit of the general type outlined hereinbefore. Similar arrangements are shown in GB 2351513, U.S. Pat. No. 6,394,200, EP 1085167, EP 1039095 and US 2004/0099448.

In one aspect, the invention provides a drilling tool in which the disadvantages set out hereinbefore are overcome or are of reduced effect.

SUMMARY OF THE INVENTION

According to the present invention there is provided a drilling tool comprising a body having main drilling region and a pilot drilling region, eccentric to the main drilling region the main drilling region including a plurality of main blades and the pilot drilling region including a plurality of pilot blades, the main drilling region defining a main pass through diameter, centred upon a first axis, at least one of the main blades extending to the main pass through diameter, the pilot region defining a pilot gauge diameter, centred upon a second axis of rotation at least one of the pilot blades extending to the pilot gauge diameter, wherein part of a circle of diameter equal to the pilot gauge diameter and centred upon the second axis of rotation is spaced outside of a circle of diameter equal to the main pass through diameter and centred upon the first axis.

Preferably at least one of the pilot blades stops short of the pilot gauge diameter, extending only to a part of the main pass through diameter.

Such an arrangement is advantageous in that the pilot region can be of increased diameter, thus benefiting from enhanced stability and increased tool sizes, whilst permitting relatively large diameter hole regions to be drilled.

It will be appreciated that the circle of diameter equal to the pilot gauge diameter and the circle of diameter equal to the main pass through diameter intersect at two spaced locations. Preferably a blade is located at each said location, these blades conveniently serving as both main and pilot blades.

The main blades are conveniently interconnected with one another by a series of gauge pads. Flow passages are preferably provided beneath the gauge pads to permit the passage of fluid. The gauge pads and blades together preferably define a gauge ring. The gauge ring is preferably of generally circular cross-section, but preferably includes a region of a different radius of curvature located diametrically opposite the location of the side at least one pilot blade that stops short of the pilot gauge diameter.

BRIEF SUMMARY OF THE INVENTION

According to the present invention there is provided a drilling tool comprising a body having main drilling region and a pilot drilling region, eccentric to the main drilling region the main drilling region including a plurality of main blades and the pilot drilling region including a plurality of pilot blades, the main drilling region defining a main pass through diameter, centred upon a first axis, at least one of the main blades extending to the main pass through diameter, the pilot region defining a pilot gauge diameter, centred upon a second axis of rotation at least one of the pilot blades extending to the pilot gauge diameter, wherein part of a circle of diameter equal to the pilot gauge diameter and centred upon the second axis of rotation is spaced outside of a circle of diameter equal to the main pass through diameter and centred upon the first axis.

Preferably at least one of the pilot blades stops short of the pilot gauge diameter, extending only to a part of the main pass through diameter.

Such an arrangement is advantageous in that the pilot region can be of increased diameter, thus benefiting from enhanced stability and increased tool sizes, whilst permitting relatively large diameter hole regions to be drilled.

It will be appreciated that the circle of diameter equal to the pilot gauge diameter and the circle of diameter equal to the main pass through diameter intersect at two spaced locations. Preferably a blade is located at each said location, these blades conveniently serving as both main and pilot blades.

The main blades are conveniently interconnected with one another by a series of gauge pads. Flow passages are preferably provided beneath the gauge pads to permit the passage of fluid. The gauge pads and blades together preferably define a gauge ring. The gauge ring is preferably of generally circular cross-section, but preferably includes a region of a different radius of curvature located diametrically opposite the location of the side at least one pilot blade that stops short of the pilot gauge diameter.

BRIEF DESCRIPTION OF THE DRAWINGS

The invention will further be described, by way of example, with reference to the accompanying drawings, in which.

DETAILED DESCRIPTION OF THE INVENTION

Figure 1:
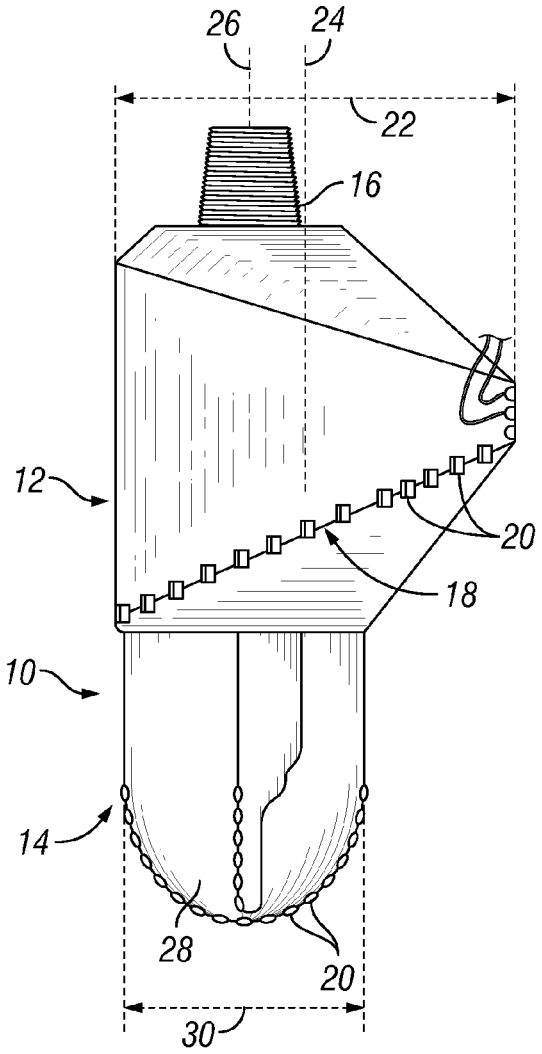
FIG. 1 (Prior Art)
FIG. 1 is a diagrammatic representation of a prior art bi-centre drill bit.
Figure 2:
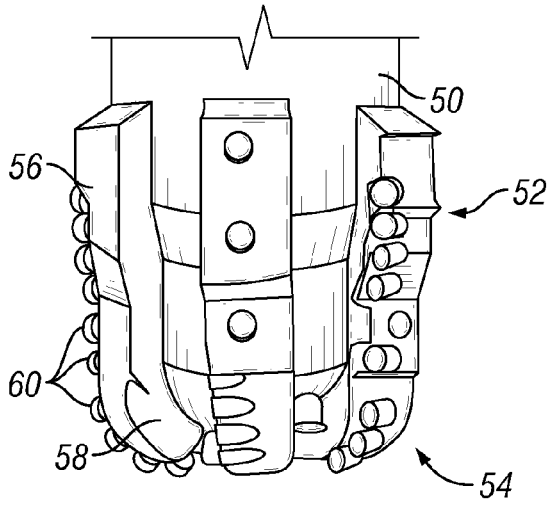
FIG. 2 is a diagrammatic view of a drill bit according to one embodiment of the invention.
Figure 3:
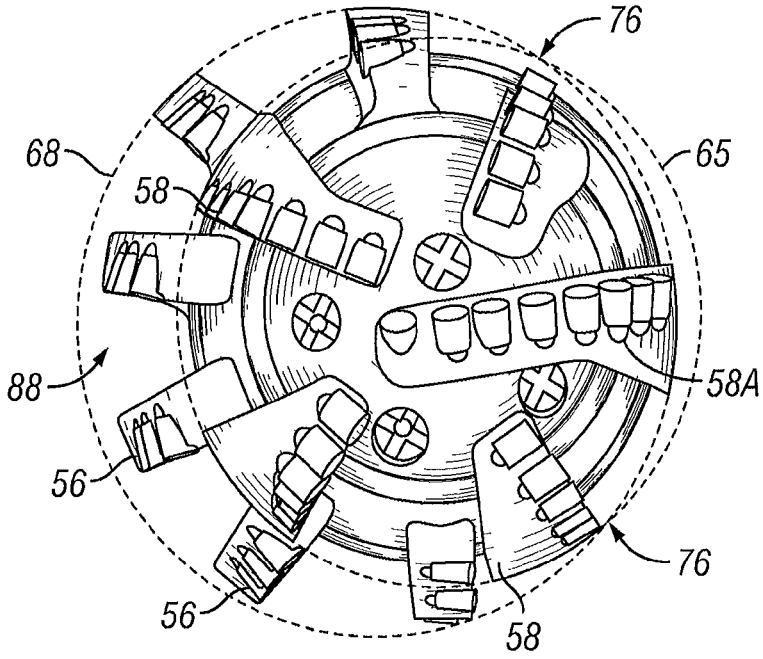
FIG. 3 is an end view illustrating the drill bit of FIG. 2.
Figure 4:
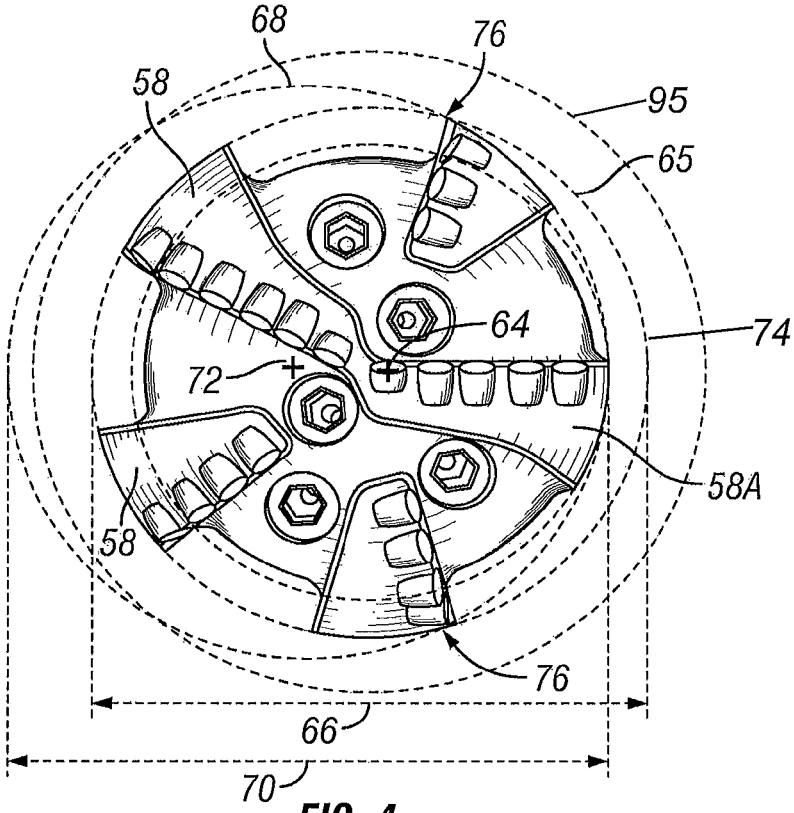
FIG. 4 is a diagrammatic view illustrating operation of the drill bit of FIG. 2.

Referring firstly to FIG. 1 there is illustrated a prior art bi-centre bit comprising a bit body 10 defining a main drilling region 12 and a pilot drilling region 14. The bit body 10 further includes a mounting pin region 16 whereby the bit can be secured to other downhole tools to support the bit, permit a weight-on-bit loading to be applied to the bit and to allow the bit to be driven for rotation.

The main drilling region 12 of the bit body 10 includes a plurality of upstanding blades 18 (only one of which is visible), each of which has mounted thereon a plurality of cutting elements 20, for example in the form of polycrystalline diamond compact cutting elements. At least some of the blades 18 extend outwards to a main pass through diameter 22 which is centred upon an axis 24 offset or eccentric to an axis of rotation 26 of the bit.

The pilot drilling region 14 also includes a plurality of upstanding blades 28 which, like the blades 18 of the main drilling region 12, carry a plurality of cutting elements 20. The blades 28 of the pilot drilling region 14 extend outwards away from the axis of rotation 26 to a pilot gauge diameter 30 which is centred upon the axis of rotation 26. As is clear from FIG. 1, a pilot gauge circle of diameter equal to the pilot gauge diameter 30 is centred upon the axis 26 of rotation is located entirely within a pass through circle of diameter equal to the main pass through diameter 22 and centred on the axis 24.

In use, rotation of the drill bit about its axis of rotation 26 whilst a weight on bit loading is applied thereto results in the pilot drilling region 14 drilling a relatively small diameter hole which is subsequently widened or extended by the main drilling region 12. The main drilling region 12 is of larger diameter than the pilot drilling region 14, and is also arranged eccentrically thereto with the result that the diameter of the finished hole is significantly larger than the pilot hole, the radius of the finished hole being substantially equal to the radial distance from the axis of rotation 26 to the edge of the blade 18 of the main drilling region 12 most remote from the axis of rotation 26. During such expansion of the hole, the engagement between the pilot region 14 of the bit and the walls of the pilot hole serves to stabilise the bit, reacting the sideways acting loads applied thereto resulting from the blades 18 of the main drilling region 12 being eccentrically arranged relative to the axis of rotation 26.

Although capable of drilling relatively large diameter holes, the bi-centre bit is capable of drilling or being passed through a hole of much smaller diameter, the bit being able to travel through an opening of diameter equal to the main pass through diameter 22.

As mentioned hereinbefore, such an arrangement has the disadvantages that the maximum diameter of downhole tools with which the bit can be used is relatively small, and also the stability of the bit is fairly poor.

In accordance with one embodiment of the invention, as shown in FIGS. 2 to 5, a drill bit comprises a bit body 50, for example of cast steel form, which defines a main drilling region 52 and a pilot drilling region 54. As with the known arrangement, the main and pilot drilling regions 52, 54 are each provided with series of upstanding blades 56, 58, the blades each carry a plurality of cutting elements 60. The bit body 50 further includes a mounting pin (not shown) whereby it can be connected to other downhole tools to allow the drill bit to be supported in a desired position, to have a weight-on-bit loading applied thereto, and to transmit rotary motion to the bit.

The main drilling region 52, as described hereinbefore, includes a plurality of main blades 56 (not shown in FIG. 4), at least some of the main blades 56 extending outwards to a pass through circle 68 of pass through diameter 70.

The pilot drilling region 54, also as described above, includes a plurality of pilot blades 58. The pilot drilling region 54 is centred upon an axis of rotation 64 of the drill bit, and most of the pilot blades 58 extend away from the axis of rotation 64 to a pilot gauge circle 65 of pilot gauge diameter 66. The pilot gauge circle 65 is centred upon the axis of rotation 64. The pass through circle 68 is centred upon an axis 72 spaced from the axis of rotation 64, and the diameters 66, 70 are such that a part 74 of the pilot gauge circle 65 projects outside of the pass through circle 68. Although most of the pilot blades 58 extend to the pilot gauge circle 65, one of the pilot blades (denoted by numeral 58*a*) extends in the direction at which the pilot gauge circle 65 projects beyond the pass through circle 68, and this blade 58*a* stops short of the pilot gauge diameter 66, only extending as far as the pass through circle 68. Although in this embodiment only one blade 58*a* is so located, arrangements are possible in which two or more blades 58*a* extend in the direction in which the pilot gauge circle 65 projects beyond the pass through circle 68, and in such arrangements each blades 58*a* stops short of the pilot gauge diameter 66, extending only to pass through circle 68.

Figure 5A:
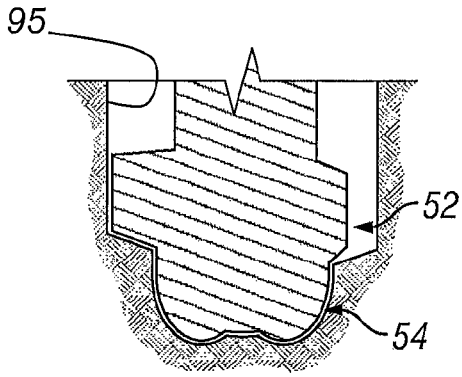
FIGS. 5*a* and 5*b* are diagrammatic representations of the drill bit, in use.
Figure 5B:
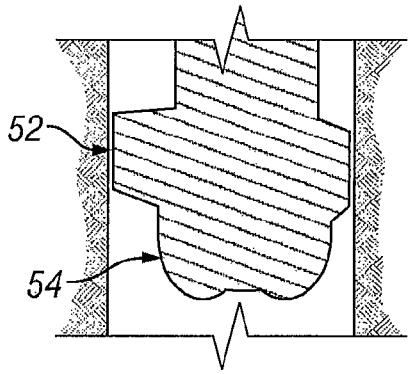

It will be appreciated that by incorporating shortened pilot blades 58*a* in this part of the drill bit, a relatively large pilot gauge diameter 66 can be achieved. As a result, bit stability can be enhanced. These benefits can be achieved without increasing the size of the pass through diameter, and without reducing the maximum drilling diameter of the bit. FIGS. 5*a* and 5*b* illustrate, respectively, the bit being used to drill a borehole region 95 of relatively large diameter, and being passed through a relatively small diameter region, and it is clear from these drawings that, despite the bit having a relatively large pilot gauge diameter, compared to typical arrangements, the invention still permits the formation of borehole regions of considerably larger diameter than the pass through diameter of the bit.

The pilot gauge circle 65 intersects with the pass through circle 68 at two points 76, and conveniently blades serving as both pilot and main blades 56, 58 are located at these points 76. Such an arrangement is advantageous in that stability, particularly of the pilot region, is enhanced as these blades provide points of contact with the formation adjacent either side of the part of the pilot where the shortened blade 58*a* is located. The points 76 are preferably spaced apart from one another by a distance sufficient that an angle of 80-130°, preferably about 100° is subtended by them at the axis 64.

Figure 6:
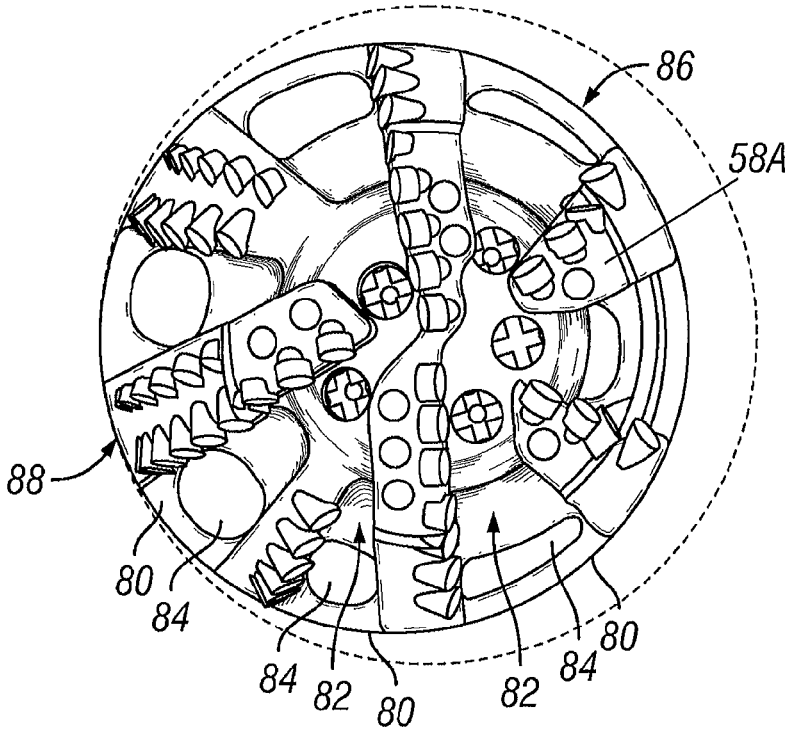
FIG. 6 is a view similar to FIG. 3, but illustrating an alternative embodiment.

Referring next to FIG. 6 there is illustrated an alternative arrangement. For the most part the arrangement of FIG. 6 is the same as or very similar to that of FIG. 3 and so only the significant differences will be described herein in detail.

In the arrangement of FIG. 6, a series of gauge pads 80 are provided, each gauge pad 80 interconnecting two adjacent ones of the main blades 56, spanning the channels 82 formed therebetween. The gauge pads 80 and adjacent parts of the main blades 56 together define a continuous gauge ring 86. Although not illustrated, the gauge surface of the gauge ring may be provided with a suitable wear resistant coating or inserts. Further, although illustrates as being continuous, the gauge ring 86 could be of part-circular, discontinuous form if desired. Flow passages 84 are formed beneath the gauge pads 80, between the gauge pads 80 and the main body 50, allowing fluid to flow along the channels 82 past the gauge ring 86.

The gauge ring 86 is of generally circular form, but may include a region 88 of different, preferably larger, diameter located opposite the blades 58*a*. Likewise, in the arrangement of FIGS. 2 to 5 the blades 56 may stop short of the pass-through circle 68 in this region.

Whereas the present invention has been described in particular relation to the drawings attached hereto, it should be understood that other and further modifications apart from those shown or suggested herein, may be made within the scope and spirit of the present invention. Although the description herein is of a drill bit, it will be appreciated that the invention is also applicable to other types of drilling tools, for example to reamers and the like. Further, it will be appreciated that a wide range of modifications and alterations may be made to the arrangement described herein without departing from the scope of the invention.

What is claimed is:

1. A drilling tool comprising:

a body having a main drilling region and a pilot drilling region eccentric to the main drilling region, the main drilling region including a plurality of main blades and the pilot drilling region including a plurality of pilot blades;

the main drilling region defining a main pass-through diameter, centered upon a first axis;

at least one of the main blades extending to the main pass through diameter; and the pilot region defining a pilot gauge diameter, centered upon a second axis;

wherein part of the circle of diameter equal to the pilot gauge diameter and centered upon the second axis is spaced outside of the circle of diameter equal to the main pass through diameter and centered upon the first axis, wherein at least one of the pilot blades extending to the pilot gauge diameter; and wherein at least one of the pilot blades stops short of the pilot gauge diameter, extending only to a part of the main pass through diameter.

2. The tool of claim 1, wherein adjacent ones of the main blades are interconnected with one another by a series of gauge pads.

3. The tool of claim 2, further comprising flow passages provided beneath the gauge pads to permit the passage of fluid.

4. The tool of claim 2, wherein the gauge pads and blades together define a gauge ring.

5. The tool of claim 2, wherein the gauge ring is of generally circular cross-section, but includes a region of a different radius of curvature location diametrically opposite the location of the said at least one pilot blade that stops short of the pilot gauge diameter.

6. A drilling tool comprising:

a body having a main drilling region and a pilot drilling region eccentric to the main drilling region, the main drilling region including a plurality of main blades and the pilot drilling region on including a plurality of pilot blades;

the main drilling region defining a main pass-through diameter, centered upon a first axis;

at least one of the main blades extending to the main pass through diameter; and the pilot region defining a pilot gauge diameter, centered upon a second axis;

wherein part of the circle of diameter equal to the pilot gauge diameter and centered upon the second axis is spaced outside of the circle of diameter equal to the main pass through diameter and centered upon the first axis, wherein at least one of the pilot blades extending to the pilot gauge diameter, and wherein the circle of diameter equal to the pilot gauge diameter and the circle of diameter equal to the main pass-through diameter intersects at two spaced locations, and a pilot blade is located at each said location.

7. The tool of claim 6, wherein a blade serving as both a main blade and a pilot blade is located at each of said two spaced locations.

8. The tool of claim 6, wherein the said locations subtend at an angle at the second axis of 80-130°.

9. The tool of claim 8, wherein the said locations subtend at an angle at the second axis of 100°.

10. The tool of claim 6, wherein adjacent ones of the main blades are interconnected with one another by a series of gauge pads.

11. The tool of claim 10, further comprising flow passages provided beneath the gauge pads to permit the passage of fluid.

12. The tool of claim 10, wherein the gauge pads and blades together define a gauge ring.

13. The tool of claim 10, wherein the gauge ring is of generally circular cross-section, but includes a region of a different radius of curvature location diametrically opposite the location of the said at least one pilot blade that stops short of the pilot gauge diameter.

* * * * *